US007524383B2

(12) United States Patent
Parent et al.

(10) Patent No.: US 7,524,383 B2
(45) Date of Patent: Apr. 28, 2009

(54) METHOD AND SYSTEM FOR PASSIVATING A PROCESSING CHAMBER

(75) Inventors: Wayne M. Parent, Austin, TX (US); Dan R. Geshell, Glendale, AZ (US)

(73) Assignee: Tokyo Electron Limited, Tokyo (JP)

( * ) Notice: Subject to any disclaimer, the term of this patent is extended or adjusted under 35 U.S.C. 154(b) by 516 days.

(21) Appl. No.: 11/137,155

(22) Filed: May 25, 2005

(65) Prior Publication Data

US 2006/0266287 A1 Nov. 30, 2006

(51) Int. Cl.

| | |
|---|---|
| ***C23C 22/00*** | (2006.01) |
| ***C23C 22/50*** | (2006.01) |
| *B08B 9/08* | (2006.01) |
| *B08B 5/00* | (2006.01) |

(52) U.S. Cl. ..... 148/243; 148/240; 134/22.1; 134/22.12; 134/22.19; 134/26; 134/28; 134/30

(58) Field of Classification Search ..... 148/240, 148/243; 134/22.1, 22.12, 22.19, 28, 30
See application file for complete search history.

(56) References Cited

U.S. PATENT DOCUMENTS

| | | | | |
|---|---|---|---|---|
| 2,617,719 | A | 11/1952 | Stewart | 23/312 |
| 2,625,886 | A | 1/1953 | Browne | 103/150 |
| 3,744,660 | A | 7/1973 | Gaines et al. | 220/10 |
| 3,968,885 | A | 7/1976 | Hassan et al. | 214/1 BC |
| 4,029,517 | A | 6/1977 | Rand | 134/11 |
| 4,091,643 | A | 5/1978 | Zucchini | 68/18 C |
| 4,245,154 | A | 1/1981 | Uehara et al. | 250/227 |
| 4,341,592 | A | 7/1982 | Shortes et al. | 156/643 |
| 4,355,937 | A | 10/1982 | Mack et al. | 414/217 |
| 4,367,140 | A | 1/1983 | Wilson | 210/110 |
| 4,406,596 | A | 9/1983 | Budde | 417/393 |
| 4,422,651 | A | 12/1983 | Platts | 277/206 R |
| 4,474,199 | A | 10/1984 | Blaudszun | 134/105 |
| 4,522,788 | A | 6/1985 | Sitek et al. | 422/78 |
| 4,549,467 | A | 10/1985 | Wilden et al. | 91/307 |

(Continued)

FOREIGN PATENT DOCUMENTS

| | | |
|---|---|---|
| CH | SE 251213 | 8/1948 |

(Continued)

OTHER PUBLICATIONS

J. B. Rubin et al., *A Comparison of Chilled DI Water/Ozone and $CO_2$-based Supercritical Fluids as Replacements for Photoresist-Stripping Solvents*, IEEE/CPMT Int'l Electronics Manufacturing Technology Symposium, pp. 308-314, 1998.

(Continued)

*Primary Examiner*—Roy King
*Assistant Examiner*—Lois L. Zheng
(74) *Attorney, Agent, or Firm*—Wood, Herron & Evans, L.L.P.

(57) ABSTRACT

A method and system for passivating a processing chamber is provided, whereby the processing chamber is exposed to one or more cycles of citric acid, or nitric acid. The processing chamber is fabricated, for example, from stainless steel. Each cycle may be performed at a pressure greater than atmospheric pressure, or a temperature greater than 20 degrees centigrade, or both.

3 Claims, 4 Drawing Sheets

U.S. PATENT DOCUMENTS

| | | | | |
|---|---|---|---|---|
| 4,592,306 | A | 6/1986 | Gallego | 118/719 |
| 4,601,181 | A | 7/1986 | Privat | 68/18 C |
| 4,626,509 | A | 12/1986 | Lyman | 435/287 |
| 4,670,126 | A | 6/1987 | Messer et al. | 204/298 |
| 4,682,937 | A | 7/1987 | Credle, Jr. | 417/393 |
| 4,693,777 | A | 9/1987 | Hazano et al. | 156/345 |
| 4,749,440 | A | 6/1988 | Blackwood et al. | 156/646 |
| 4,778,356 | A | 10/1988 | Hicks | 417/397 |
| 4,788,043 | A | 11/1988 | Kagiyama et al. | 422/292 |
| 4,789,077 | A | 12/1988 | Noe | 220/319 |
| 4,823,976 | A | 4/1989 | White, III et al. | 220/211 |
| 4,825,808 | A | 5/1989 | Takahashi et al. | 118/719 |
| 4,827,867 | A | 5/1989 | Takei et al. | 118/64 |
| 4,838,476 | A | 6/1989 | Rahn | 228/180.1 |
| 4,865,061 | A | 9/1989 | Fowler et al. | 134/108 |
| 4,879,431 | A | 11/1989 | Bertoncini | 435/311 |
| 4,917,556 | A | 4/1990 | Stark et al. | 414/217 |
| 4,924,892 | A | 5/1990 | Kiba et al. | 134/123 |
| 4,944,837 | A | 7/1990 | Nishikawa et al. | 156/646 |
| 4,951,601 | A | 8/1990 | Maydan et al. | 118/719 |
| 4,960,140 | A | 10/1990 | Ishijima et al. | 134/31 |
| 4,983,223 | A | 1/1991 | Gessner | 134/25.4 |
| 5,011,542 | A | 4/1991 | Weil | 134/38 |
| 5,013,366 | A | 5/1991 | Jackson et al. | 134/1 |
| 5,044,871 | A | 9/1991 | Davis et al. | 414/786 |
| 5,062,770 | A | 11/1991 | Story et al. | 417/46 |
| 5,068,040 | A | 11/1991 | Jackson | 210/748 |
| 5,071,485 | A | 12/1991 | Matthews et al. | 134/2 |
| 5,105,556 | A | 4/1992 | Kurokawa et al. | 34/12 |
| 5,143,103 | A | 9/1992 | Basso et al. | 134/98.1 |
| 5,167,716 | A | 12/1992 | Boitnott et al. | 118/719 |
| 5,169,296 | A | 12/1992 | Wilden | 417/395 |
| 5,169,408 | A | 12/1992 | Biggerstaff et al. | 29/25.01 |
| 5,185,296 | A | 2/1993 | Morita et al. | 437/229 |
| 5,186,594 | A | 2/1993 | Toshima et al. | 414/217 |
| 5,186,718 | A | 2/1993 | Tepman et al. | 29/25.01 |
| 5,188,515 | A | 2/1993 | Horn | 417/63 |
| 5,190,373 | A | 3/1993 | Dickson et al. | 366/146 |
| 5,191,993 | A | 3/1993 | Wanger et al. | 220/333 |
| 5,193,560 | A | 3/1993 | Tanaka et al. | 134/56 R |
| 5,195,878 | A | 3/1993 | Sahiavo et al. | 417/393 |
| 5,213,485 | A | 5/1993 | Wilden | 417/393 |
| 5,213,619 | A | 5/1993 | Jackson et al. | 134/1 |
| 5,215,592 | A | 6/1993 | Jackson | 134/1 |
| 5,217,043 | A | 6/1993 | Novakovi | 137/460 |
| 5,221,019 | A | 6/1993 | Pechacek et al. | 220/315 |
| 5,222,876 | A | 6/1993 | Budde | 417/393 |
| 5,224,504 | A | 7/1993 | Thompson et al. | 134/155 |
| 5,236,602 | A | 8/1993 | Jackson | 210/748 |
| 5,236,669 | A | 8/1993 | Simmons et al. | 422/113 |
| 5,237,824 | A | 8/1993 | Pawliszyn | 62/51.1 |
| 5,240,390 | A | 8/1993 | Kvinge et al. | 417/393 |
| 5,243,821 | A | 9/1993 | Schuck et al. | 62/50.6 |
| 5,246,500 | A | 9/1993 | Samata et al. | 118/719 |
| 5,251,776 | A | 10/1993 | Morgan, Jr. et al. | 220/360 |
| 5,267,455 | A | 12/1993 | Dewees et al. | 68/5 C |
| 5,280,693 | A | 1/1994 | Heudecker | 53/306 |
| 5,285,352 | A | 2/1994 | Pastore et al. | 361/707 |
| 5,288,333 | A | 2/1994 | Tanaka et al. | 134/31 |
| 5,304,515 | A | 4/1994 | Morita et al. | 437/231 |
| 5,306,350 | A | 4/1994 | Hoy et al. | 134/22.14 |
| 5,313,965 | A | 5/1994 | Palen | 134/61 |
| 5,314,574 | A | 5/1994 | Takahashi | 156/646 |
| 5,316,591 | A | 5/1994 | Chao et al. | 134/34 |
| 5,328,722 | A | 7/1994 | Ghanayem et al. | 427/250 |
| 5,337,446 | A | 8/1994 | Smith et al. | 15/21.1 |
| 5,339,844 | A | 8/1994 | Stanford, Jr. et al. | 134/107 |
| 5,355,901 | A | 10/1994 | Mielnik et al. | 134/105 |
| 5,368,171 | A | 11/1994 | Jackson | 134/147 |
| 5,370,740 | A | 12/1994 | Chao et al. | 134/1 |
| 5,370,741 | A | 12/1994 | Bergman | 134/3 |
| 5,377,705 | A | 1/1995 | Smith, Jr. et al. | 134/95.3 |
| 5,401,322 | A | 3/1995 | Marshall | 134/13 |
| 5,403,621 | A | 4/1995 | Jackson et al. | 427/255.1 |
| 5,404,894 | A | 4/1995 | Shiraiwa | 134/66 |
| 5,412,958 | A | 5/1995 | Iliff et al. | 68/5 C |
| 5,417,768 | A | 5/1995 | Smith, Jr. et al. | 134/10 |
| 5,433,334 | A | 7/1995 | Reneau | 220/319 |
| 5,447,294 | A | 9/1995 | Sakata et al. | 266/257 |
| 5,456,759 | A | 10/1995 | Stanford, Jr. et al. | 134/1 |
| 5,494,526 | A | 2/1996 | Paranjpe | 134/1 |
| 5,500,081 | A | 3/1996 | Bergman | 156/646.1 |
| 5,501,761 | A | 3/1996 | Evans et al. | 156/344 |
| 5,503,176 | A | 4/1996 | Dummire et al. | 137/15 |
| 5,505,219 | A | 4/1996 | Lansberry et al. | 134/105 |
| 5,509,431 | A | 4/1996 | Smith, Jr. et al. | 134/95.1 |
| 5,522,938 | A | 6/1996 | O'Brien | 134/1 |
| 5,526,834 | A | 6/1996 | Mielnik et al. | 134/105 |
| 5,533,538 | A | 7/1996 | Marshall | 134/104.4 |
| 5,571,330 | A | 11/1996 | Kyogoku | 118/719 |
| 5,589,224 | A | 12/1996 | Tepman et al. | 427/248.1 |
| 5,621,982 | A | 4/1997 | Yamashita et al. | 34/203 |
| 5,629,918 | A | 5/1997 | Ho et al. | 369/112 |
| 5,644,855 | A | 7/1997 | McDermott et al. | 34/516 |
| 5,649,809 | A | 7/1997 | Stapelfeldt | 417/63 |
| 5,656,097 | A | 8/1997 | Olesen et al. | 134/1 |
| 5,669,251 | A | 9/1997 | Townsend et al. | 68/58 |
| 5,672,204 | A | 9/1997 | Habuka | 117/204 |
| 5,683,977 | A | 11/1997 | Jureller et al. | 510/286 |
| 5,702,228 | A | 12/1997 | Tamai et al. | 414/744.5 |
| 5,706,319 | A | 1/1998 | Holtz | 376/203 |
| 5,746,008 | A | 5/1998 | Yamashita et al. | 34/211 |
| 5,769,588 | A | 6/1998 | Toshima et al. | 414/217 |
| 5,797,719 | A | 8/1998 | James et al. | 417/46 |
| 5,798,126 | A | 8/1998 | Fujikawa et al. | 425/78 |
| 5,817,178 | A | 10/1998 | Mita et al. | 118/666 |
| 5,868,856 | A | 2/1999 | Douglas et al. | 134/2 |
| 5,868,862 | A | 2/1999 | Douglas et al. | 134/26 |
| 5,881,577 | A | 3/1999 | Sauer et al. | 68/5 |
| 5,882,165 | A | 3/1999 | Maydan et al. | 414/217 |
| 5,888,050 | A | 3/1999 | Fitzgerald et al. | 417/46 |
| 5,898,727 | A | 4/1999 | Fujikawa et al. | 373/110 |
| 5,900,107 | A | 5/1999 | Murphy et al. | 156/359 |
| 5,900,354 | A | 5/1999 | Batchelder | 430/395 |
| 5,904,737 | A | 5/1999 | Preston et al. | 8/158 |
| 5,906,866 | A | 5/1999 | Webb | 427/534 |
| 5,908,510 | A | 6/1999 | McCullough et al. | 134/2 |
| 5,928,389 | A | 7/1999 | Jevtic | 29/25.01 |
| 5,932,100 | A | 8/1999 | Yager et al. | 210/634 |
| 5,934,856 | A | 8/1999 | Asakawa et al. | 414/217 |
| 5,934,991 | A | 8/1999 | Rush | 454/187 |
| 5,955,140 | A | 9/1999 | Smith et al. | 427/96 |
| 5,975,492 | A | 11/1999 | Brenes | 251/175 |
| 5,976,264 | A | 11/1999 | McCullough et al. | 134/2 |
| 5,979,306 | A | 11/1999 | Fujikawa et al. | 100/90 |
| 5,980,648 | A | 11/1999 | Adler | 134/34 |
| 5,981,399 | A | 11/1999 | Kawamura et al. | 438/715 |
| 5,989,342 | A | 11/1999 | Ikeda et al. | 118/52 |
| 6,005,226 | A | 12/1999 | Aschner et al. | 219/390 |
| 6,017,820 | A | 1/2000 | Ting et al. | 438/689 |
| 6,024,801 | A | 2/2000 | Wallace et al. | 134/1 |
| 6,029,371 | A | 2/2000 | Kamikawa et al. | 34/516 |
| 6,035,871 | A | 3/2000 | Eui-Yeol | 134/61 |
| 6,037,277 | A | 3/2000 | Masakara et al. | 438/787 |
| 6,053,348 | A | 4/2000 | Morch | 220/263 |
| 6,056,008 | A | 5/2000 | Adams et al. | 137/487.5 |
| 6,067,728 | A | 5/2000 | Farmer et al. | 34/470 |
| 6,077,053 | A | 6/2000 | Fujikawa et al. | 417/399 |
| 6,077,321 | A | 6/2000 | Adachi et al. | 29/25.01 |
| 6,082,150 | A | 7/2000 | Stucker | 68/18 R |
| 6,085,935 | A | 7/2000 | Malchow et al. | 220/813 |
| 6,097,015 | A | 8/2000 | McCullough et al. | 219/686 |
| 6,110,232 | A | 8/2000 | Chen et al. | 29/25.01 |
| 6,122,566 | A | 9/2000 | Nguyen et al. | 700/218 |

| | | | | |
|---|---|---|---|---|
| 6,128,830 | A | 10/2000 | Bettcher et al. | 34/404 |
| 6,145,519 | A | 11/2000 | Konishi et al. | 134/95.2 |
| 6,149,828 | A | 11/2000 | Vaartstra | 216/57 |
| 6,159,295 | A | 12/2000 | Maskara et al. | 118/688 |
| 6,164,297 | A | 12/2000 | Kamikawa | 134/61 |
| 6,186,722 | B1 | 2/2001 | Shirai | 414/217 |
| 6,203,582 | B1 | 3/2001 | Berner et al. | 29/25.01 |
| 6,216,364 | B1 | 4/2001 | Tanaka et al. | 34/448 |
| 6,228,563 | B1 | 5/2001 | Starov et al. | 430/327 |
| 6,235,634 | B1 | 5/2001 | White et al. | 438/680 |
| 6,239,038 | B1 | 5/2001 | Wen | 438/745 |
| 6,241,825 | B1 | 6/2001 | Wytman | 118/733 |
| 6,242,165 | B1 | 6/2001 | Vaartstra | 430/329 |
| 6,244,121 | B1 | 6/2001 | Hunter | 73/865.9 |
| 6,251,250 | B1 | 6/2001 | Keigler | 205/89 |
| 6,277,753 | B1 | 8/2001 | Mullee et al. | |
| 6,286,231 | B1 | 9/2001 | Bergman et al. | 34/410 |
| 6,305,677 | B1 | 10/2001 | Lenz | 269/13 |
| 6,306,564 | B1 | 10/2001 | Mullee | |
| 6,319,858 | B1 | 11/2001 | Lee et al. | 438/787 |
| 6,334,266 | B1 | 1/2002 | Moritz et al. | 34/337 |
| 6,344,174 | B1 | 2/2002 | Miller et al. | 422/98 |
| 6,355,072 | B1 | 3/2002 | Racette et al. | 8/142 |
| 6,388,317 | B1 | 5/2002 | Reese | 257/713 |
| 6,389,677 | B1 | 5/2002 | Lenz | 29/559 |
| 6,418,956 | B1 | 7/2002 | Bloom | 137/14 |
| 6,436,824 | B1 | 8/2002 | Chooi et al. | 438/687 |
| 6,454,519 | B1 | 9/2002 | Toshima et al. | 414/805 |
| 6,454,945 | B1 | 9/2002 | Weigl et al. | 210/634 |
| 6,464,790 | B1 | 10/2002 | Sherstinsky et al. | 118/715 |
| 6,508,259 | B1 | 1/2003 | Tseronis et al. | 134/105 |
| 6,509,141 | B2 | 1/2003 | Mullee | |
| 6,521,466 | B1 | 2/2003 | Castrucci | 438/5 |
| 6,541,278 | B2 | 4/2003 | Morita et al. | 438/3 |
| 6,546,946 | B2 | 4/2003 | Dunmire | 137/15.18 |
| 6,550,484 | B1 | 4/2003 | Gopinath et al. | 134/1.2 |
| 6,558,475 | B1 | 5/2003 | Jur et al. | 134/21 |
| 6,561,213 | B2 | 5/2003 | Wang et al. | 137/263 |
| 6,561,220 | B2 | 5/2003 | McCullough et al. | 137/565.12 |
| 6,561,481 | B1 | 5/2003 | Filonczuk | 251/129.12 |
| 6,561,767 | B2 | 5/2003 | Berger et al. | 417/53 |
| 6,564,826 | B2 | 5/2003 | Shen | 137/505.18 |
| 6,596,093 | B2 | 7/2003 | DeYoung et al. | |
| 6,666,928 | B2 * | 12/2003 | Worm | 134/33 |
| 6,802,961 | B2 | 10/2004 | Jackson | 210/86 |
| 6,880,560 | B2 * | 4/2005 | Ching et al. | 134/1.3 |
| 6,890,853 | B2 | 5/2005 | Biberger et al. | 438/670 |
| 2002/0046707 | A1 | 4/2002 | Biberger et al. | |
| 2003/0196679 | A1 | 10/2003 | Cotte et al. | |
| 2003/0198895 | A1 | 10/2003 | Toma et al. | |
| 2004/0003831 | A1 | 1/2004 | Mount | |
| 2004/0020518 | A1 | 2/2004 | DeYoung et al. | 134/30 |
| 2004/0112409 | A1 | 6/2004 | Schilling | |
| 2004/0177867 | A1 | 9/2004 | Schilling | |
| 2004/0231707 | A1 * | 11/2004 | Schilling et al. | 134/34 |
| 2005/0077597 | A1 | 4/2005 | Toma et al. | |

FOREIGN PATENT DOCUMENTS

| | | | |
|---|---|---|---|
| CN | 1399790 | | 2/2003 |
| DE | 36 08 783 | A1 | 9/1987 |
| DE | 39 04 514 | C2 | 3/1990 |
| DE | 40 04 111 | C2 | 8/1990 |
| DE | 39 06 724 | C2 | 9/1990 |
| DE | 39 06 735 | C2 | 9/1990 |
| DE | 39 06 737 | A1 | 9/1990 |
| DE | 44 29 470 | A1 | 3/1995 |
| DE | 43 44 021 | A1 | 6/1995 |
| DE | 198 60 084 | A1 | 7/2000 |
| EP | 0 244 951 | A2 | 11/1987 |
| EP | 02 72 141 | A2 | 6/1988 |
| EP | 0 283 740 | A2 | 9/1988 |
| EP | 0 302 345 | A2 | 2/1989 |
| EP | 0 370 233 | A1 | 5/1990 |
| EP | 0 391 035 | A2 | 10/1990 |
| EP | 0 453 867 | A1 | 10/1991 |
| EP | 0 518 653 | B1 | 12/1992 |
| EP | 0 536 752 | A2 | 4/1993 |
| EP | 0 572 913 | A1 | 12/1993 |
| EP | 0 587 168 | A1 | 3/1994 |
| EP | 0 620 270 | A3 | 10/1994 |
| EP | 0 679 753 | B1 | 11/1995 |
| EP | 0 711 864 | B1 | 5/1996 |
| EP | 0 726 099 | A2 | 8/1996 |
| EP | 0 727 711 | A2 | 8/1996 |
| EP | 0 822 583 | A2 | 2/1998 |
| EP | 0 829 312 | A2 | 3/1998 |
| EP | 0 836 895 | A2 | 4/1998 |
| EP | 0 903 775 | A2 | 3/1999 |
| FR | 1 499 491 | | 9/1967 |
| GB | 2 003 975 | | 3/1979 |
| GB | 2 193 482 | | 2/1988 |
| JP | 60-192333 | | 9/1985 |
| JP | 60-2348479 | | 11/1985 |
| JP | 60-246635 | | 12/1985 |
| JP | 61-017151 | | 1/1986 |
| JP | 61-231166 | | 10/1986 |
| JP | 62-111442 | | 5/1987 |
| JP | 62-125619 | | 6/1987 |
| JP | 63-256326 | | 10/1988 |
| JP | 63-303059 | | 12/1988 |
| JP | 1-045131 | | 2/1989 |
| JP | 1-246835 | | 10/1989 |
| JP | 2-148841 | | 6/1990 |
| JP | 2-209729 | | 8/1990 |
| JP | 2-304941 | | 12/1990 |
| JP | 4-284648 | | 10/1992 |
| JP | 7-142333 | | 6/1995 |
| JP | 8-186140 | A | 7/1996 |
| JP | 8-222508 | A | 8/1996 |
| JP | 10-144757 | A | 5/1998 |
| JP | 56-142629 | | 11/1998 |
| JP | 10335408 | A | 12/1998 |
| JP | 11-200035 | | 7/1999 |
| JP | 2000-106358 | | 4/2000 |
| WO | WO 87/07309 | | 12/1987 |
| WO | WO 90/06189 | | 6/1990 |
| WO | WO 90/13675 | | 11/1990 |
| WO | WO 91/12629 | A | 8/1991 |
| WO | WO 93/14255 | | 7/1993 |
| WO | WO 93/14259 | | 7/1993 |
| WO | WO 93/20116 | | 10/1993 |
| WO | WO 96/27704 | | 9/1996 |
| WO | WO 99/18603 | A | 4/1999 |
| WO | WO 99/49998 | | 10/1999 |
| WO | WO 00/36635 | | 6/2000 |
| WO | WO 00/73241 | A1 | 12/2000 |
| WO | WO 01/10733 | A1 | 2/2001 |
| WO | WO 01/33615 | A3 | 5/2001 |
| WO | WO 01/55628 | A1 | 8/2001 |
| WO | WO 01/68279 | A2 | 9/2001 |
| WO | WO 01/74538 | A1 | 10/2001 |
| WO | WO 01/78911 | A1 | 10/2001 |
| WO | WO 01/85391 | A2 | 11/2001 |
| WO | WO 01/94782 | A2 | 12/2001 |
| WO | WO 02/09894 | A2 | 2/2002 |
| WO | WO 02/11191 | A2 | 2/2002 |
| WO | WO 02/16051 | A2 | 2/2002 |
| WO | WO 03/064065 | A1 | 8/2003 |
| WO | WO 03/030219 | A2 | 10/2003 |

OTHER PUBLICATIONS

*Los Alamos National Laboratory*, Solid State Technology, pp. S10 & S14, Oct. 1998.

*Supercritical Carbon Dioxide Resist Remover, SCORR, the Path to Least Photoresistance*, Los Alamos National Laboratory, 1998.
Z. Guan et al., *Fluorocarbon-Based Heterophase Polymeric Materials. I. Block Copolymer Surfactants for Carbon Dioxide Applications*, Macromolecules, vol. 27, pp. 5527-5532, 1994.
*International Journal of Environmentally Conscious Design & Manufacturing*, vol. 2, No. 1, pp. 83, 1993.
Matson and Smith , *Supercritical Fluids*, Journal of the American Ceramic Society, vol. 72, No. 6, pp. 872-874.
D. H. Ziger et al., *Compressed Fluid Technology: Application to RIE Developed Resists*AIChE Journal, vol. 33, No. 10, pp. 1585-1591, Oct. 1987.
Kirk-Othmer, *Alcohol Fuels to Toxicology*, Encyclopedia of Chemical Terminology, 3rd ed., Supplement vol., New York: John Wiley & Sons, pp. 872-893, 1984.
*Cleaning with Supercritical $CO_2$*, NASA Tech Briefs, MFS-29611, Marshall Space Flight Center, Alabama, Mar. 1979.
N. Basta, *Supercritical Fluids: Still Seeking Acceptance*, Chemical Engineering vol. 92, No. 3, pp. 14, Feb. 24, 1985.
D. Takahashi, *Los Alamos Lab Finds Way to Cut Chip Toxic Waste*, Wall Street Journal, Jun. 22, 1998.
*Supercritical $CO_2$ Process Offers Less Mess from Semiconductor Plants*, Chemical Engineering Magazine, pp. 27 & 29, Jul. 1988.
Y. P. Sun, *Preparation of Polymer Protected Semiconductor Nanoparticles Through the Rapid Expansion of Supercritical Fluid Solution*, Chemical Physics Letters, pp. 585-588, May 22, 1998.
K. Jackson et al., *Surfactants and Micromulsions in Supercritical Fluids*, Supercritical Fluid Cleaning, Noyes Publications, Westwood, NJ, pp. 87-120, Spring 1998.
M. Kryszewski, *Production of Metal and Semiconductor Nanoparticles in Polymer Systems*, Polimery, pp. 65-73, Feb. 1998.
G. L. Bakker et al., *Surface Cleaning and Carbonaceous Film Removal Using High Pressure, High Temperature Water, and Water/$CO_2$ Mixtures*, J Electrochem Soc., vol. 145, No. 1, pp. 284-291, Jan. 1998.
C. K. Ober et al., *Imaging Polymers with Supercritical Carbon Dioxide*, Advanced Materials, vol. 9, No. 13, pp. 1039-1043, Nov. 3, 1997.
E. M. Russick et al., *Supercritical Carbon Dioxide Extraction of Solvent from Micro-Machined Structures*, Supercritical Fluids Extraction and Pollution Prevention, ACS Symposium Series, vol. 670, pp. 255-269, Oct. 21, 1997.
N. Dahmen et al., *Supercritical Fluid Extraction of Grinding and Metal Cutting Waste Contaminated with Oils*, Supercritical Fluids—Extraction and Pollution Prevention, ACS Symposium Series, vol. 670, pp. 270-279, Oct. 21, 1997.
C. M. Wai, *Supercritical Fluid Extraction: Metals as Complexes*, Journal of Chromatography A, vol. 785, pp. 369-383, Oct. 17, 1997.
C. Xu et al., *Submicron-Sized Spherical Yttrium Oxide Based Phosphors Prepared by Supercritical $CO_2$-Assisted Nerosolization and Pyrolysis*, Appl. Phys. Lett., vol. 71, No. 22, pp. 1643-1645, Sep. 22, 1997.
Y. Tomioka et al., *Decomposition of Tetramethylammonium (TMA) in a Positive Photo-resist Developer by Supercritical Water*, Abstracts of Papers 214th ACS Natl Meeting, American Chemical Society, Abstract No. 108, Sep. 7, 1997.
H. Klein et al., *Cyclic Organic Carbonates Serve as Solvents and Reactive Diluents*, Coatings World, pp. 38-40, May 1997.
J. Bühler et al., *Linear Array of Complementary Metal Oxide Semiconductor Double-Pass Metal Micro-mirrors*, Opt. Eng. vol. 36, No. 5, pp. 1391-1398, May 1997.
M. H. Jo et al., *Evaluation of $SiO_2$ Aerogel Thin Film with Ultra Low Dielectric Constant as an Intermetal Dielectric*, Micrelectronic Engineering, vol. 33, pp. 343-348, Jan. 1997.
J. B. McClain et al., *Design of Nonionic Surfactants for Supercritical Carbon Dioxide* , Science, vol. 274, pp. 2049-2052, Dec. 20, 1996.
L. Znaidi et al., *Batch and Semi-Continuous Synthesis of Magnesium Oxide Powders from Hydrolysis and Supercritical Treatment of $Mg(OCH_3)_2$*, Materials Research Bulletin, vol. 31, No. 12, pp. 1527-1535, Dec. 1996.
M. E. Tadros, *Synthesis of Titanium Dioxide Particles in Supercritical $CO_2$*, J. Supercritical Fluids, vol. 9, pp. 172-176, Sep. 1996.
V. G. Courtecuisse et al., *Kinetics of the Titanium Isopropoxide Decomposition in Supercritical Isopropyl Alcohol*, Ind. Eng. Chem. Res., vol. 35, No. 8, pp. 2539-2545, Aug. 1996.
A. Gabor et al., *Block and Random Copolymer Resists Designed for 193 nm Lithography and Environmentally Friendly Supercritical $CO_2$Development*, SPIE, vol. 2724, pp. 410-417, Jun. 1996.
G. L. Schimek et al., *Supercritical Ammonia Synthesis and Characterization of Four New Alkali Metal Silver Antimony Sulfides* . . . , J. Solid State Chemistry, vol. 123, pp. 277-284, May 1996.
P. Gallagher-Wetmore et al., *Supercritical Fluid Processing: Opportunities for New Resist Materials and Processes*, SPIE, vol. 2725, pp. 289-299, Apr. 1996.
K. I. Papathomas et al., *Debonding of Photoresists by Organic Solvents*, J. Applied Polymer Science, vol. 59, pp. 2029-2037, Mar. 28, 1996.
J. J. Watkins et al., *Polymer/Metal Nanocomposite Synthesis in Supercritical $CO_2$*, Chemistry of Materials, vol. 7, No. 11, pp. 1991-1994, Nov. 1995.
E. F. Gloyna et al., *Supercritical Water Oxidation Research and Development Update*, Environmental Progress, vol. 14, No. 3, pp. 182-192, Aug. 1995.
P. Gallagher-Wetmore et al., *Supercritical Fluid Processing: A New Dry Technique for Photoresist Developing*, SPIE, vol. 2438, pp. 694-708, Jun. 1995.
A. H. Gabor et al., *Silicon-Containing Block Copolymer Resist Materials*, Microelectronics Technology—Polymers for Advanced Imaging and Packaging, ACS Symposium Series, vol. 615, pp. 281-298, Apr. 1995.
P. C. Tsiartas et al., *Effect of Molecular Weight Distribution on the Dissolution Properties of Novolac Blends*, SPIE, vol. 2438, pp. 264-271, Jun. 1995.
R. D. Allen et al., *Performance Properties of Near-Monodisperse Novolak Resins*, SPIE, vol. 2438, pp. 250-260, Jun. 1995.
P. T. Wood et al., *Synthesis of New Channeled Structures in Supercritical Amines* . . . , Inorg. Chem., vol. 33, pp. 1556-1558, 1994.
J. B. Jerome et al., *Synthesis of New Low-Dimensional Quaternary Compounds* . . . , Inorg. Chem., vol. 33, pp. 1733-1734, 1994.
J. McHardy et al., *Progress in Supercritical $CO_2$ Cleaning*, SAMPE Jour. vol. 29, No. 5, pp. 20-27, Sep. 1993.
R. Purtell et al., *Precision Parts Cleaning Using Supercritical Fluids*, J. Vac. Sci. Technol. A., vol. 11, No. 4, pp. 1696-1701, Jul. 1993.
E. Bok et al., *Supercritical Fluids for Single Wafer Cleaning*, Solid State Technology, pp. 117-120, Jun. 1992.
T. Adschiri et al., *Rapid and Continuous Hydrothermal Crystallization of Metal Oxide Particles in Supercritical Water*, J. Am. Ceram. Cos., vol. 75, No. 4, pp. 1019-1022, 1992.
B. N. Hansen et al., *Supercritical Fluid Transport—Chemical Deposition of Films*, Chem. Mater, vol. 4, No. 4, pp. 749-752, 1992.
S. H. Page et al., *Predictability and Effect of Phase Behavior of $CO_2$/Propylene Carbonate in Supercritical Fluid Chromatography*, J. Microcol, vol. 3, No. 4, pp. 355-369, 1991.
T. Brokamp et al., *Synthese und Kristallstruktur Eines Gemischtvalenten Lithium-Tantalnitride $Li_2Ta_3N_5$*, J. Alloys and Compounds, vol. 176, pp. 47-60, 1991.
B. M. Hybertson et al., *Deposition of Palladium Films by a Novel Supercritical Transport Chemical Deposition Process*, Mat. Res. Bull., vol. 26, pp. 1127-1133, 1991.
D. W. Matson et al., *Rapid Expansion of Supercritical Fluid Solutions: Solute Formation of Powders, Thin Films, and Fibers*, Ind. Eng. Chem. Res., vol. 26, No. 11, pp. 2298-2306, 1987.
W. K. Tolley et al., *Stripping Organics from Metal and Mineral Surfaces Using Supercritical Fluids*, Separation Science and Technology, vol. 22, pp. 1087-1101, 1987.
*Final Report on the Safety Assessment of Propylene Carbonate*, J. American College of Toxicology, vol. 6, No. 1, pp. 23-51, 1987.
*Porous Xerogel Films as Ultra-Low Permittivity Dielectrics for ULSI Interconnect Applications*, Materials Research Society, pp. 463-469, 1987.
Kawakami et al., *A Super Low-K($k=1.1$) Silica Aerogel Film Using Supercritical Drying Technique*, IEEE, pp. 143-145, 2000.

R. F. Reidy, *Effects of Supercritical Processing on Ultra Low-k Films*, Texas Advanced Technology Program, Texas Instruments and the Texas Academy of Mathematics and Science.
Anthony Muscat, *Backend Processing Using Supercritical $CO_2$*, University of Arizona.
D. Goldfarb et al., *Aqueous-based Photoresist Drying Using Supercritical Carbon Dioxide to Prevent Pattern Collapse*, J. Vacuum Sci. Tech. B, vol. 18, No. 6, pp. 3313, 2000.
H. Namatsu et al., *Supercritical Drying for Water-Rinsed Resist Systems*, J. Vacuum Sci. Tech. B, vol. 18, No. 6, pp. 3308, 2000.
N. Sundararajan et al., *Supercritical $CO_2$ Processing for Submicron Imaging of Fluoropolymers*, Chem. Mater., vol. 12, 41, 2000.
Hideaki Itakura et al., *Multi-Chamber Dry Etching System*, Solid State Technology, pp. 209-214, Apr. 1982.
Joseph L. Foszez, *Diaphragm Pumps Eliminate Seal Problems*, Plant Engineering, pp. 1-5, Feb. 1, 1996.
Bob Agnew, *WILDEN Air-Operated Diaphragm Pumps*, Process & Industrial Training Technologies, Inc., 1996.

* cited by examiner

METHOD AND SYSTEM FOR PASSIVATING A PROCESSING CHAMBER

BACKGROUND OF THE INVENTION

1. Field of the Invention

The present invention relates to a method and system for passivating a processing chamber having internal members fabricated from stainless steel and, more particularly, to a method and system for passivating stainless steel members by exposing the members to an acid source, such as citric acid or nitric acid, at a pressure greater than atmospheric pressure, or a temperature greater than 20 degrees centigrade, or both.

2. Description of Related Art

During the fabrication of semiconductor devices for integrated circuits (ICs), a critical processing requirement for processing semiconductor devices is cleanliness. The processing of semiconductor devices includes vacuum processing, such as etch and deposition processes whereby material is removed from or added to a substrate surface, as well as atmospheric processing, such as wet cleaning whereby contaminants or residue accumulated during processing are removed. For example, the removal of residue, such as photoresist (serving as a light-sensitive mask for etching), post-etch residue, and post-ash residue subsequent to the etching of features, such as trenches or vias, can utilize plasma ashing with an oxygen plasma followed by wet cleaning.

Other critical processing requirements for the processing of semiconductor devices include substrate throughput and reliability. Production processing of semiconductor devices in a semiconductor fabrication facility requires a large capital outlay for processing equipment. In order to recover these expenses and generate sufficient income from the fabrication facility, the processing equipment requires a specific substrate throughput and a reliable process in order to ensure the achievement of this throughput.

Until recently, plasma ashing and wet cleaning were found to be sufficient for removing residue and contaminants accumulated during semiconductor processing. However, recent advancements for ICs include a reduction in the critical dimension for etched features below a feature dimension acceptable for wet cleaning, such as a feature dimension below 45 to 65 nanometers, as well as the introduction of new materials, such as low dielectric constant (low-k) materials, which are susceptible to damage during plasma ashing.

Therefore, at present, interest has developed for the replacement of plasma ashing and wet cleaning. One interest includes the development of dry cleaning systems utilizing a supercritical fluid as a carrier for a solvent, or other residue removing composition. Post-etch and post-ash cleaning are examples of such systems. Other interests include other processes and applications that can benefit from the properties of supercritical fluids or high pressure fluids, particularly of substrates having features with a dimension of 65 nm, or 45 nm, or smaller. Such processes and applications may include restoring low dielectric films after etching, sealing porous films, drying of applied films, depositing materials, as well as other processes and applications. However, high pressure processing systems utilizing supercritical fluids and high pressure fluids must meet cleanliness requirements imposed by the semiconductor processing community. Additionally, high pressure processing systems must meet throughput requirements, as well as reliability requirements.

In order to meet the cleanliness requirements imposed by the semiconductor manufacturing community, processing systems utilized for substrate cleaning are fabricated from stainless steel, and they are subsequently passivated by exposing the stainless steel to citric acid, nitric acid, or a mixture thereof. The processing system is exposed to the acid source at atmospheric conditions for a period of time; however, the processing systems still suffer from lack of cleanliness issues, such as metal contamination.

SUMMARY OF THE INVENTION

One embodiment of the present invention is to reduce or eliminate any or all of the above-described problems.

Another embodiment of the present invention is to provide a method of passivating internal members in a processing system.

According to one embodiment, a method of treating an internal member configured to be coupled to a processing system is described, comprising: disposing the internal member in a treating system, wherein the internal member is composed substantially of stainless steel; exposing the internal member to a passivation composition in the treating system; elevating a pressure of the passivation composition above atmospheric pressure; and elevating a temperature of the passivation composition above 20 degrees centigrade.

According to another embodiment, a high pressure processing system for treating a substrate comprises: a processing chamber configured to support the substrate, wherein the processing chamber comprises at least one internal member fabricated from stainless steel; a high pressure fluid supply system coupled to the processing chamber, and configured to introduce a high pressure fluid to the processing chamber; a process chemistry supply system coupled to the processing chamber, and configured to introduce a process chemistry to the processing chamber; a passivation chemistry supply system coupled to the processing chamber, and configured to introduce a passivation chemistry to the processing chamber in order to passivate the at least one internal member of the processing chamber, wherein the passivation chemistry is introduced at a pressure greater than atmospheric pressure and a temperature greater than 20 degrees C.; and a fluid flow system coupled to the processing chamber, and configured to circulate through said processing chamber: any one of, or any combination of, said high pressure fluid, said process chemistry, and said passivation chemistry.

According to another embodiment of the invention, an internal member that is configured to be coupled to a high pressure processing system is treated by disposing, in a high pressure treating system, an internal member that is composed substantially of stainless steel and has sites thereon that were contaminated when coupled to the high pressure processing system; providing passivation chemistry in the treating system at a pressure sufficiently above atmospheric pressure to expose contaminated sites that would not normally be exposed to chemistry provided at atmospheric pressure; and exposing the internal member to the passivation chemistry in the high pressure treating system at said pressure that is sufficiently above atmospheric pressure. The treating system may or may not be the same system as the high pressure processing system.

DETAILED DESCRIPTION OF EXEMPLARY EMBODIMENTS

In the following description, to facilitate a thorough understanding of the invention and for purposes of explanation and not limitation, specific details are set forth, such as a particular geometry of the processing system and various descriptions of the internal members. However, it should be understood that the invention may be practiced with other embodiments that depart from these specific details. For example, although embodiments are presented for processing systems utilized for dry cleaning in semiconductor manufacturing, the invention has applicability to a wide range of processing systems having internal members fabricated from stainless steel. In particular, processing vessels used in the medical and bioscience fields having stringent cleanliness requirements and may also benefit from the invention.

Nonetheless, it should be appreciated that, contained within the description are features which, notwithstanding the inventive nature of the general concepts being explained, are also of an inventive nature.

In many chemical processes, the chemicals employed to facilitate the chemical process can be highly corrosive. Not only are such chemicals corrosive to the internal members of the chemical processing system within which the chemical processes are performed, but also the corrosion of the chemical processing system can be detrimental to the process since contaminants, such as metal contamination, may be introduced to, for example, the substrate upon which the process is performed.

Figure 1:
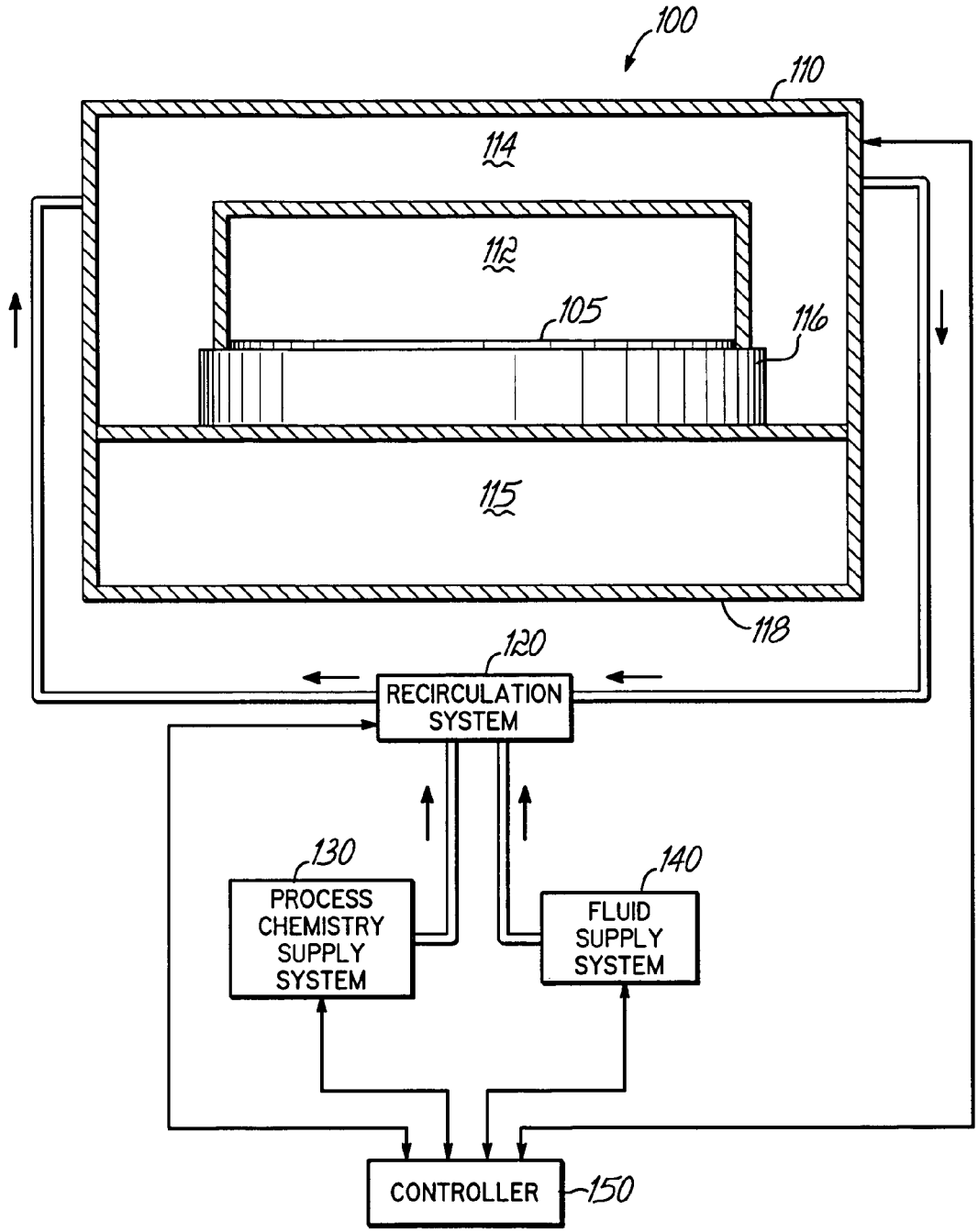
FIG. 1 presents a simplified schematic representation of a processing system in accordance with an embodiment of the invention.

Referring now to the drawings, wherein like reference numerals designate identical or corresponding parts throughout the several views, FIG. 1 illustrates a processing system 100 according to an embodiment of the invention. In the illustrated embodiment, processing system 100 comprises processing elements that include a processing chamber 110, a fluid flow system 120, a process chemistry supply system 130, a high pressure fluid supply system 140, and a controller 150, all of which are configured to process substrate 105. The controller 150 can be coupled to the processing chamber 110, the fluid flow system 120, the process chemistry supply system 130, and the high pressure fluid supply system 140. The process chemistry supply system 130 comprises a passivation chemistry source, such as an acid source, configured to supply a passivation chemistry for passivating internal members of processing system 100. Alternately, or in addition, controller 150 can be coupled to one or more additional controllers/computers (not shown), and controller 150 can obtain setup and/or configuration information from an additional controller/computer.

In FIG. 1, singular processing elements (110, 120, 130, 140, and 150) are shown, but this is not required for the invention. The processing system 100 can comprise any number of processing elements having any number of controllers associated with them in addition to independent processing elements.

The controller 150 can be used to configure any number of processing elements (110, 120, 130, and 140), and the controller 150 can collect, provide, process, store, and display data from processing elements. The controller 150 can comprise a number of applications for controlling one or more of the processing elements. For example, controller 150 can include a graphic user interface (GUI) component (not shown) that can provide easy to use interfaces that enable a user to monitor and/or control one or more processing elements. The controller 150 can be programmed to configure the systems 100 or 120 to perform processes and process steps described herein.

Referring still to FIG. 1, the fluid flow system 120 is configured to flow fluid and chemistry from the supplies 130 and 140 through the processing chamber 110. The fluid flow system 120 is illustrated as a recirculation system through which the fluid and chemistry recirculate from and back to the processing chamber 110. This recirculation is most likely to be the preferred configuration for many applications, but this is not necessary to the invention. Fluids, particularly inexpensive fluids, can be passed through the processing chamber once and then discarded, which might be more efficient than reconditioning them for re-entry into the processing chamber. Accordingly, while the fluid flow system is described as a recirculating system in the exemplary embodiments, a non-recirculating system may, in some cases, be substituted. This fluid flow system or recirculation system 120 can include one or more valves for regulating the flow of a processing solution through the recirculation system 120 and through the processing chamber 110. The recirculation system 120 can comprise any number of back-flow valves, filters, pumps, and/or heaters (not shown) for maintaining a specified temperature, pressure or both for the processing solution and flowing the process solution through the recirculation system 120 and through the processing chamber 110. Furthermore, any one of the many components provided within the fluid flow system 120 may be heated to a temperature consistent with the specified process temperature.

Referring still to FIG. 1, the processing system 100 can comprise high pressure fluid supply system 140. The high pressure fluid supply system 140 can be coupled to the recirculation system 120, but this is not required. In alternate embodiments, high pressure fluid supply system 140 can be configured differently and coupled differently. For example, the fluid supply system 140 can be coupled directly to the processing chamber 110. The high pressure fluid supply system 140 can include a supercritical fluid supply system. A supercritical fluid as referred to herein is a fluid that is in a supercritical state, which is that state that exists when the fluid is maintained at or above the critical pressure and at or above the critical temperature on its phase diagram. In such a supercritical state, the fluid possesses certain properties, one of which is the substantial absence of surface tension. Accordingly, a supercritical fluid supply system, as referred to herein, is one that delivers to a processing chamber a fluid that assumes a supercritical state at the pressure and temperature at which the processing chamber is being controlled. Furthermore, it is only necessary that at least at or near the critical point the fluid is in substantially a supercritical state at which its properties are sufficient, and exist long enough, to realize their advantages in the process being performed. Carbon dioxide, for example, is a supercritical fluid when maintained at or above a pressure of about 1070 Psi at a temperature of 31 degrees C.

As described above, the fluid supply system 140 can include a supercritical fluid supply system, which can be a carbon dioxide supply system. For example, the fluid supply system 140 can be configured to introduce a high pressure fluid having a pressure substantially near the critical pressure for the fluid. Additionally, the fluid supply system 140 can be configured to introduce a supercritical fluid, such as carbon dioxide in a supercritical state. Additionally, for example, the fluid supply system 140 can be configured to introduce a supercritical fluid, such as supercritical carbon dioxide, at a pressure ranging from approximately the critical pressure of carbon dioxide to 10,000 Psi. Examples of other supercritical fluid species useful in the broad practice of the invention include, but are not limited to, carbon dioxide (as described above), oxygen, argon, krypton, xenon, ammonia, methane, methanol, dimethyl ketone, hydrogen, and sulfur hexafluoride. The fluid supply system can, for example, comprise a carbon dioxide source (not shown) and a plurality of flow control elements (not shown) for generating a supercritical fluid. For example, the carbon dioxide source can include a $CO_2$ feed system, and the flow control elements can include supply lines, valves, filters, pumps, and heaters. The fluid supply system 140 can comprise an inlet valve (not shown) that is configured to open and close to allow or prevent the stream of supercritical carbon dioxide from flowing into the processing chamber 110. For example, controller 150 can be used to determine fluid parameters such as pressure, temperature, process time, and flow rate.

Referring still to FIG. 1, the process chemistry supply system 130 is coupled to the recirculation system 120, but this is not required for the invention. In alternate embodiments, the process chemistry supply system 130 can be configured differently, and can be coupled to different elements in the processing system 100. The process chemistry is introduced by the process chemistry supply system 130 into the fluid introduced by the fluid supply system 140 at ratios that vary with the substrate properties, the chemistry being used and the process being performed in the processing chamber. Usually the ratio is roughly 1 to 5 percent by volume, which, for a chamber, recirculation system and associated plumbing having a volume of about one liter amounts to about 10 to 50 milliliters of additive in most cases, but the ratio may be higher or lower.

The process chemistry supply system 130 can be configured to introduce one or more of the following process compositions, but not limited to: cleaning compositions for removing contaminants, residues, hardened residues, photoresist, hardened photoresist, post-etch residue, post-ash residue, post chemical-mechanical polishing (CMP) residue, post-polishing residue, or post-implant residue, or any combination thereof; cleaning compositions for removing particulate; drying compositions for drying thin films, porous thin films, porous low dielectric constant materials, or air-gap dielectrics, or any combination thereof; film-forming compositions for preparing dielectric thin films, metal thin films, or any combination thereof; healing compositions for restoring the dielectric constant of low dielectric constant (low-k) films; sealing compositions for sealing porous films; passivating compositions for passivating internal members of the processing system 100; or any combination thereof. Additionally, the process chemistry supply system 130 can be configured to introduce solvents, co-solvents, surfactants, etchants, acids, bases, chelators, oxidizers, film-forming precursors, or reducing agents, or any combination thereof.

The process chemistry supply system 130 can be configured to introduce N-methyl pyrrolidone (NMP), diglycol amine, hydroxyl amine, di-isopropyl amine, tri-isoprpyl amine, tertiary amines, catechol, ammonium fluoride, ammonium bifluoride, methylacetoacetamide, ozone, propylene glycol monoethyl ether acetate, acetylacetone, dibasic esters, ethyl lactate, $CHF_3$, $BF_3$, HF, other fluorine containing chemicals, or any mixture thereof. Other chemicals such as organic solvents may be utilized independently or in conjunction with the above chemicals to remove organic materials. The organic solvents may include, for example, an alcohol, ether, and/or glycol, such as acetone, diacetone alcohol, dimethyl sulfoxide (DMSO), ethylene glycol, methanol, ethanol, propanol, or isopropanol (IPA). For further details, see U.S. Pat. No. 6,306,564B1, filed May 27, 1998, and titled "REMOVAL OF RESIST OR RESIDUE FROM SEMICONDUCTORS USING SUPERCRITICAL CARBON DIOXIDE", and U.S. Pat. No. 6,509,141B2, filed Sep. 3, 1999, and titled "REMOVAL OF PHOTORESIST AND PHOTORESIST RESIDUE FROM SEMICONDUCTORS USING SUPERCRITICAL CARBON DIOXIDE PROCESS," both incorporated by reference herein.

Additionally, the process chemistry supply system 130 can comprise a cleaning chemistry assembly (not shown) for providing cleaning chemistry for generating supercritical cleaning solutions within the processing chamber. The cleaning chemistry can include peroxides and a fluoride source. For example, the peroxides can include hydrogen peroxide, benzoyl peroxide, or any other suitable peroxide, and the fluoride sources can include fluoride salts (such as ammonium fluoride salts), hydrogen fluoride, fluoride adducts (such as organo-ammonium fluoride adducts), and combinations thereof. Further details of fluoride sources and methods of generating supercritical processing solutions with fluoride sources are described in U.S. patent application Ser. No. 10/442,557, filed May 20, 2003, and titled "TETRA-ORGANIC AMMONIUM FLUORIDE AND HF IN SUPERCRITICAL FLUID FOR PHOTORESIST AND RESIDUE REMOVAL", and U.S. patent application Ser. No. 10/321,341, filed Dec. 16, 2002, and titled "FLUORIDE IN SUPERCRITICAL FLUID FOR PHOTORESIST POLYMER AND RESIDUE REMOVAL," both incorporated by reference herein.

Furthermore, the process chemistry supply system 130 can be configured to introduce chelating agents, complexing agents and other oxidants, organic and inorganic acids that can be introduced into the supercritical fluid solution with one or more carrier solvents, such as N,N-dimethylacetamide (DMAc), gamma-butyrolactone (BLO), dimethyl sulfoxide (DMSO), ethylene carbonate (EC), butylenes carbonate (BC), propylene carbonate (PC), N-methyl pyrrolidone (NMP), dimethylpiperidone, propylene carbonate, and alcohols (such a methanol, ethanol and 2-propanol).

Moreover, the process chemistry supply system 130 can comprise a rinsing chemistry assembly (not shown) for providing rinsing chemistry for generating supercritical rinsing solutions within the processing chamber. The rinsing chemistry can include one or more organic solvents including, but not limited to, alcohols and ketone. In one embodiment, the rinsing chemistry can comprise sulfolane, also known as thiocyclopentane-1,1-dioxide,(cyclo)tetramethylene sulphone and 2,3,4,5-tetrahydrothiophene-1,1-dioxide, which can be purchased from a number of venders, such as Degussa Stanlow Limited, Lake Court, Hursley Winchester SO21 2LD UK.

Moreover, the process chemistry supply system 130 can be configured to introduce treating chemistry for curing, cleaning, healing (or restoring the dielectric constant of low-k materials), or sealing, or any combination thereof, low dielectric constant films (porous or non-porous). The chemistry can include hexamethyldisilazane (HMDS), chlorotrimethylsilane (TMCS), trichloromethylsilane (TCMS), dimethylsilyldiethylamine (DMSDEA), tetramethyldisilazane (TMDS), trimethylsilyldimethylamine (TMSDMA), dimethylsilyldimethylamine (DMSDMA), trimethylsilyldiethylamine (TMSDEA), bistrimethylsilyl urea (BTSU), bis(dimethylamino)methyl silane (B[DMA]MS), bis (dimethylamino)dimethyl silane (B[DMA]DS), HMCTS, dimethylaminopentamethyldisilane (DMAPMDS), dimethylaminodimethyldisilane (DMADMDS), disila-aza-cyclopentane (TDACP), disila-oza-cyclopentane (TDOCP), methyltrimethoxysilane (MTMOS), vinyltrimethoxysilane (VTMOS), or trimethylsilylimidazole (TMSI). Additionally, the chemistry may include N-tert-butyl-1,1-dimethyl-1-(2,3,4,5-tetramethyl-2, 4-cyclopentadiene-1-yl)silanamine, 1,3-diphenyl-1,1,3,3-tetramethyldisilazane, or tert-butylchlorodiphenylsilane. For further details, see U.S. patent application Ser. No. 10/682,196, filed Oct. 10, 2003, and titled "METHOD AND SYSTEM FOR TREATING A DIELECTRIC FILM," and U.S. patent application Ser. No. 10/379,984, filed Mar. 4, 2003, and titled "METHOD OF PASSIVATING LOW DIELECTRIC MATERIALS IN WAFER PROCESSING," both incorporated by reference herein.

Moreover, the process chemistry supply system 130 can be configured to introduce a peroxide during, for instance, cleaning processes. The peroxide can be introduced with any one of the above process chemistries, or any mixture thereof. The peroxide can include organic peroxides, or inorganic peroxides, or a combination thereof. For example, organic peroxides can include 2-butanone peroxide; 2,4-pentanedione peroxide; peracetic acid; t-butyl hydroperoxide; benzoyl peroxide; or m-chloroperbenzoic acid (mCPBA). Other peroxides can include hydrogen peroxide. Alternatively, the peroxide can include a diacyl peroxide, such as: decanoyl peroxide; lauroyl peroxide; succinic acid peroxide; or benzoyl peroxide; or any combination thereof. Alternatively, the peroxide can include a dialkyl peroxide, such as: dicumyl peroxide; 2,5-di(t-butylperoxy)-2,5-dimethylhexane; t-butyl cumyl peroxide; α,α-bis(t-butylperoxy)diisopropylbenzene mixture of isomers; di(t-amyl) peroxide; di(t-butyl) peroxide; or 2,5-di(t-butylperoxy)-2,5-dimethyl-3-hexyne; or any combination thereof. Alternatively, the peroxide can include a diperoxyketal, such as: 1,1-di(t-butylperoxy)-3,3,5-trimethylcyclohexane; 1,1-di(t-butylperoxy)cyclohexane; 1,1-di(t-amylperoxy)-cyclohexane; n-butyl 4,4-di(t-butylperoxy)valerate; ethyl 3,3-di-(t-amylperoxy)butanoate; t-butyl peroxy-2-ethylhexanoate; or ethyl 3,3-di(t-butylperoxy)butyrate; or any combination thereof. Alternatively, the peroxide can include a hydroperoxide, such as: cumene hydroperoxide; or t-butyl hydroperoxide; or any combination thereof. Alternatively, the peroxide can include a ketone peroxide, such as: methyl ethyl ketone peroxide; or 2,4-pentanedione peroxide; or any combination thereof. Alternatively, the peroxide can include a peroxydicarbonate, such as: di(n-propyl)peroxydicarbonate; di(sec-butyl)peroxydicarbonate; or di(2-ethylhexyl)peroxydicarbonate; or any combination thereof. Alternatively, the peroxide can include a peroxyester, such as: 3-hydroxyl-1,1-dimethylbutyl peroxyneodeca noate; α-cumyl peroxyneodeca noate; t-amyl peroxyneodecanoate; t-butyl peroxyneodecanoate; t-butyl peroxypivalate; 2,5-di (2-ethylhexanoylperoxy)-2,5-dimethylhexane; t-amyl peroxy-2-ethylhexanoate; t-butyl peroxy-2-ethylhexanoate; t-amyl peroxyacetate; t-butyl peroxyacetate; t-butyl peroxybenzoate; OO-(t-amyl) O-(2-ethylhexyl)monoperoxycarbonate; OO-(t-butyl) O-isopropyl monoperoxycarbonate; OO-(t-butyl) O-(2-ethylhexyl) monoperoxycarbonate; polyether poly-t-butylperoxy carbonate; or t-butyl peroxy-3,5,5-trimethylhexanoate; or any combination thereof. Alternatively, the peroxide can include any combination of peroxides listed above.

Moreover, the process chemistry supply system 130 is configured to introduce fluorosilicic acid. Alternatively, the process chemistry supply system is configured to introduce fluorosilicic acid with a solvent, a co-solvent, a surfactant, an acid, a base, a peroxide, or an etchant. Alternatively, the fluorosilicic acid can be introduced in combination with any of the chemicals presented above. For example, fluorosilicic acid can be introduced with N,N-dimethylacetamide (DMAc), gamma-butyrolactone (BLO), dimethyl sulfoxide (DMSO), ethylene carbonate (EC), butylene carbonate (BC), propylene carbonate (PC), N-methyl pyrrolidone (NMP), dimethylpiperidone, propylene carbonate, or an alcohol (such a methanol (MeOH), isopropyl alcohol (IPA), and ethanol).

In one embodiment, the process chemistry supply system 130 comprises a passivation chemistry source configured to supply a passivation chemistry for treating internal members of the processing system 100. For example, the passivation chemistry source may comprise an acid source configured to supply an acid, such as citric acid, or nitric acid, or both. Additionally, the process chemistry supply system 130 can be configured to introduce the passivation chemistry at high pressure, such as super-atmospheric pressure (i.e., greater than atmospheric pressure), or at high temperature, such as greater than room temperature (e.g., 20 degrees centigrade), or both.

The processing chamber 110 can be configured to process substrate 105 by exposing the substrate 105 to high pressure fluid from the high pressure fluid supply system 140, or process chemistry from the process chemistry supply system 130, or a combination thereof in a processing space 112. Additionally, processing chamber 110 can include an upper chamber assembly 114, and a lower chamber assembly 115.

The upper chamber assembly 112 can comprise a heater (not shown) for heating the processing chamber 110, the substrate 105, or the processing fluid, or a combination of two or more thereof. Alternately, a heater is not required. Additionally, the upper chamber assembly can include flow components for flowing a processing fluid through the processing chamber 110. In one example, a circular flow pattern can be established, and in another example, a substantially linear flow pattern can be established. Alternately, the flow components for flowing the fluid can be configured differently to affect a different flow pattern.

The lower chamber assembly 115 can include a platen 116 configured to support substrate 105 and a drive mechanism 118 for translating the platen 116 in order to load and unload substrate 105, and seal lower chamber assembly 115 with upper chamber assembly 114. The platen 116 can also be configured to heat or cool the substrate 105 before, during, and/or after processing the substrate 105. For example, the platen 116 can include one or more heater rods configured to elevate the temperature of the platen to approximately 31 degrees C. or greater. Additionally, the lower assembly 115 can include a lift pin assembly for displacing the substrate 105 from the upper surface of the platen 116 during substrate loading and unloading.

Additionally, controller 150 includes a temperature control system coupled to one or more of the processing chamber 110, the fluid flow system 120 (or recirculation system), the platen 116, the high pressure fluid supply system 140, or the process chemistry supply system 130. The temperature control system is coupled to heating elements embedded in one or more of these systems, and configured to elevate the temperature of the supercritical fluid to approximately 31 degrees C. or greater. The heating elements can, for example, include resistive heating elements.

A transfer system (not shown) can be used to move a substrate into and out of the processing chamber 110 through a slot (not shown). In one example, the slot can be opened and closed by moving the platen, and in another example, the slot can be controlled using a gate valve.

The substrate can include semiconductor material, metallic material, dielectric material, ceramic material, or polymer material, or a combination of two or more thereof. The semiconductor material can include Si, Ge, Si/Ge, or GaAs. The metallic material can include Cu, Al, Ni, Pb, Ti, and Ta. The dielectric material can include silica, silicon dioxide, quartz, aluminum oxide, sapphire, low dielectric constant materials, Teflon, and polyimide. The ceramic material can include aluminum oxide, silicon carbide, etc.

The processing system 100 can also comprise a pressure control system (not shown). The pressure control system can be coupled to the processing chamber 110, but this is not required. In alternate embodiments, pressure control system can be configured differently and coupled differently. The pressure control system can include one or more pressure valves (not shown) for exhausting the processing chamber 110 and/or for regulating the pressure within the processing chamber 110. Alternately, the pressure control system can also include one or more pumps (not shown). For example, one pump may be used to increase the pressure within the processing chamber, and another pump may be used to evacuate the processing chamber 110. In another embodiment, the pressure control system can comprise seals for sealing the processing chamber. In addition, the pressure control system can comprise an elevator for raising and lowering the substrate and/or the platen.

Furthermore, the processing system 100 can comprise an exhaust control system. The exhaust control system can be coupled to the processing chamber 110, but this is not required. In alternate embodiments, exhaust control system can be configured differently and coupled differently. The exhaust control system can include an exhaust gas collection vessel (not shown) and can be used to remove contaminants from the processing fluid. Alternately, the exhaust control system can be used to recycle the processing fluid.

Figure 2:
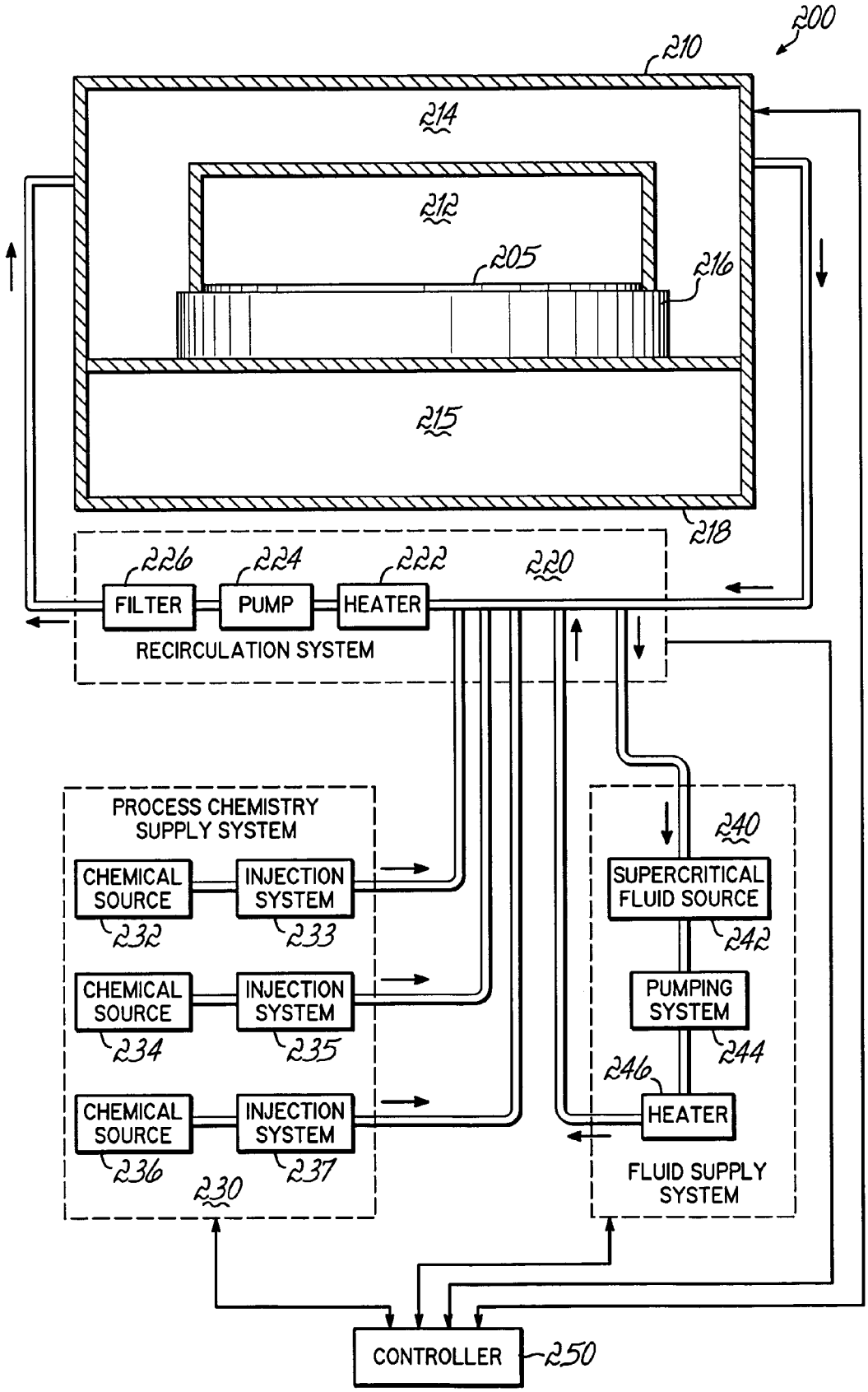
FIG. 2 presents a simplified schematic representation of a processing system in accordance with another embodiment of the invention.

Referring now to FIG. 2, a high pressure processing system 200 is presented according to another embodiment. In the illustrated embodiment, high pressure processing system 200 comprises a processing chamber 210, a recirculation system 220, a process chemistry supply system 230, a high pressure fluid supply system 240, and a controller 250, all of which are configured to process substrate 205. The controller 250 can be coupled to the processing chamber 210, the recirculation system 220, the process chemistry supply system 230, and the high pressure fluid supply system 240. Alternately, controller 250 can be coupled to one or more additional controllers/computers (not shown), and controller 250 can obtain setup and/or configuration information from an additional controller/computer.

As shown in FIG. 2, the recirculation system 220 can include a recirculation fluid heater 222, a pump 224, and a filter 226. Additionally, the process chemistry supply system 230 can include one or more chemistry introduction systems, each introduction system having a chemical source 232, 234, 236, and an injection system 233, 235, 237. The injection systems 233, 235, 237 can include a pump and an injection valve. For example, one chemical source comprises a passivation chemistry source, such as an acid source for passivating internal members fabricated from stainless steel. The acid source can include a source of citric acid, or nitric acid, or both. Additionally, an injection system associated with the passivation chemistry source can be configured to introduce the passivation chemistry under high pressure, or high temperature, or both. For instance, high pressure can include pressures greater than atmospheric pressure, and high temperature can include temperatures in excess of 20 degrees C.

Furthermore, the high pressure fluid supply system 240 can include a supercritical fluid source 242, a pumping system 244, and a supercritical fluid heater 246. Moreover, one or more injection valves, or exhaust valves may be utilized with the high pressure fluid supply system. Furthermore, temperature control elements, or pressure control elements, or both may be utilized to control the injection temperature or injection pressure of the passivation chemistry, respectively.

In yet another embodiment, the high pressure processing system can include the system described in pending U.S. patent application Ser. No. 09/912,844 (US Patent Application Publication No. 2002/0046707 A1), entitled "High pressure processing chamber for semiconductor substrates", and filed on Jul. 24, 2001, which is incorporated herein by reference in its entirety.

Additionally, the fluid, such as supercritical carbon dioxide, exits the processing chamber adjacent a surface of the substrate through one or more outlets (not shown). For example, as described in U.S. patent application Ser. No. 09/912,844, the one or more outlets can include two outlet holes positioned proximate to and above the center of substrate. The flow through the two outlets can be alternated from one outlet to the next outlet using a shutter valve.

Alternatively, the fluid, such as supercritical carbon dioxide, can enter and exit from the processing chamber as described in pending U.S. patent application Ser. No. 11/018,922 (SSIT-115), entitled "Method and System for Flowing a Supercritical Fluid in a High Pressure Processing System"; the entire content of which is herein incorporated by reference in its entirety.

A consequence of high pressure processing with corrosive chemistries is the erosion of the processing system. This corrosion can cause the introduction of unwanted metal contamination, such as iron, to the treating medium.

According to one embodiment, the internal members of the processing system are treated with a passivation composition, such as an acid. The acid can include citric acid, or nitric acid, or both. The passivation composition can further include a carrier fluid. The internal members are exposed to the passivation composition while under high pressure, such that the internal members are in an expanded state. The pressure can exceed atmospheric pressure, and can, for example, range from approximately 50 psi to approximately 10000 psi. In yet another example, the pressure ranges from approximately 100 psi to approximately 5000 psi and, by way of another example, the pressure ranges from approximately 500 psi to approximately 3500 psi. The pressure can be varied between two or more pressure levels in order to expand and contract the internal members during their exposure to the passivation chemistry. Additionally, the internal members are exposed to the passivation composition while the passivation composition is at an elevated temperature, such as a temperature exceeding approximately 20 degrees C. The temperature can, for example, range from approximately 20 degrees C. to approximately 500 degrees C. Additionally, for example, the temperature can range from approximately 20 degrees C. to approximately 200 degrees C. By way of further example, the fluid temperature can range from approximately 40 degrees C. to approximately 100 degrees C. By elevating the temperature of the passivation composition, the rate of the passivation process can be enhanced.

Internal members of the high pressure processing system have at least one surface that comes into contact with processing solution including high pressure fluid, or process chemistry, or both before, during, or after processing of a substrate. The internal members in the processing systems described in FIGS. 1 and 2 can include the processing chamber or a portion of the processing chamber, the recirculation system or a portion of the recirculation system, the process chemistry supply system or a portion of the process chemistry supply system, the high pressure fluid supply system or a portion of the high pressure fluid supply system, the upper chamber assembly or a portion of the upper chamber assembly, the lower chamber assembly or a portion of the lower chamber assembly, the platen or a portion of the platen, a valve or portion of a valve, a filter or a portion of a filter, a pump or a portion of a pump, a tube or a portion of a tube, plumbing, or a portion of the plumbing associated with the high pressure processing system, a supply tank or a portion of the supply tank, an exhaust tank or a portion of the exhaust tank, or any combination thereof. The internal member can include any member of the high pressure processing system having a surface in contact with the high pressure fluid, the process chemistry, or both before, during, or after processing of the substrate.

Internal members of the high pressure processing system can be fabricated from stainless steel, or various steel alloys such as steel alloys having high nickel and chromium content, Hastelloy steel, Nitronic 50, Nitronic 60, or 300 series stainless steel.

According to one embodiment, the internal members are passivated while they are installed in the processing system, as described in FIGS. 1 and 2. The passivation process may include a passivation composition, pressure and temperature as described above. The passivation composition may, for example, comprise a passivation chemistry injected within a carrier fluid.

Figure 3:
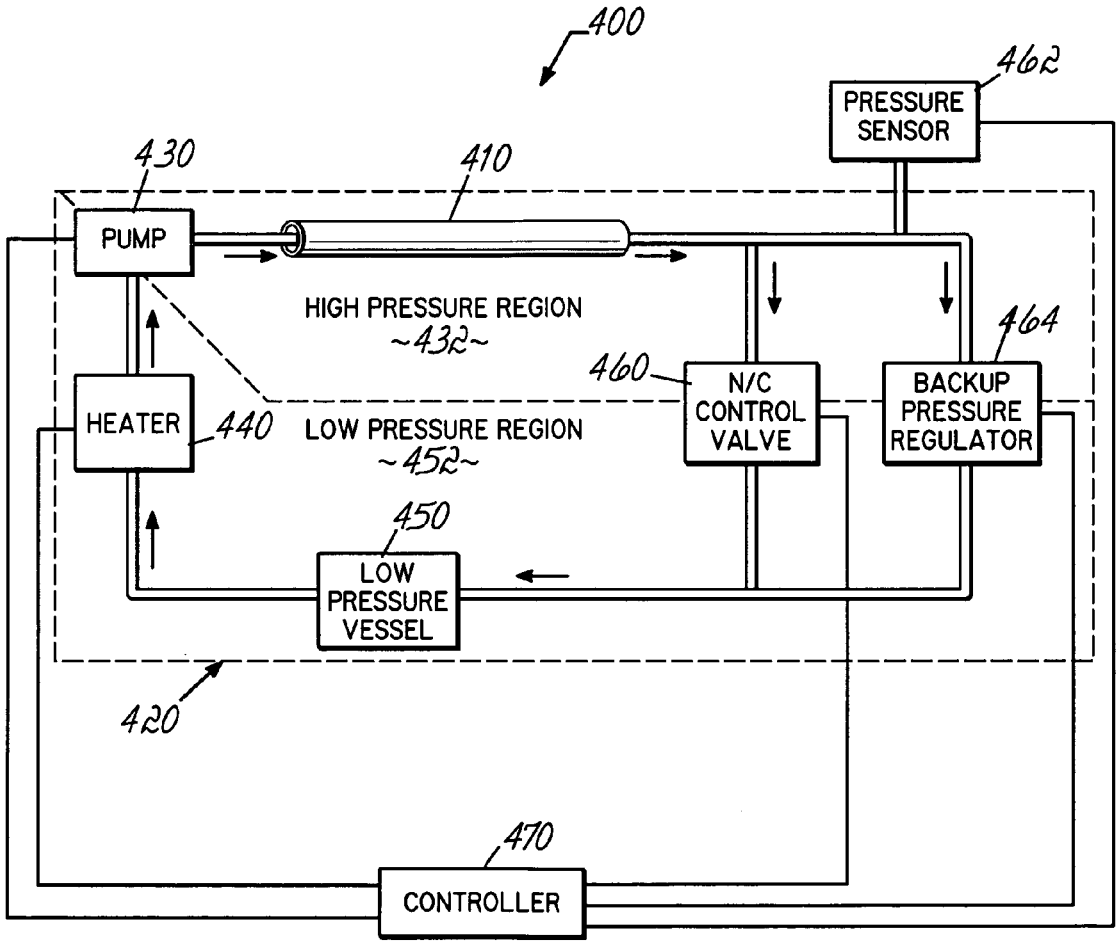
FIG. 3 illustrates a simplified schematic representation of a treating system in accordance with another embodiment of the invention.

According to another embodiment, the internal members are coupled to a treating system configured to perform a passivation process. The passivation process may include a passivation composition, pressure and temperature as described above. For example, FIG. 3 presents a schematic representation of a treating system 400 configured to treat an internal member 410 of a processing system, such as processing systems 100, 200 described in FIGS. 1 and 2. The treating system 400 comprises a fluid circulation system 420 configured to circulate a passivation composition through an internal member 410. For example, the internal member 410 can include tubing utilized in a high pressure processing system for treating a semiconductor substrate. The circulation system 420 includes a pump 430 configured to pressurize the internal member 410 in a high pressure region 432 of fluid circulation system 420. Additionally, the fluid circulation system 420 comprises a heater 440 configured to heat the passivation chemistry. For instance, the heater 440 can include a resistive heating element coupled directly to the internal member 410. Furthermore, the fluid circulation system 420 can include a low pressure vessel 450 coupled to a low pressure region 452 of the fluid circulation system and configured to store passivation composition.

Referring still to FIG. 3, the fluid circulation system 420 includes a control valve 460, pressure sensor 462, and optional back pressure regulator 464. The control valve 460 is normally closed such that the high pressure region 432 of the fluid circulation system 420 is pressurized during operation of pump 430. When the pressure within the high pressure region 432 (and internal member 410) reaches a target value, per measurement of the pressure with pressure sensor 462, the control valve 460 opens, hence, releasing the passivation composition to the low pressure region 452. The back pressure regulator 464 can be designed to open for a specific pressure, and can serve as a back-up to control valve 460 in case of failure of control valve 460. The system 400 can be controlled by a controller 470, that is connected, for example, to the valve 460, pressure regulator 464, sensor 462, pump 430, heater 440 and other components of the system 400.

Figure 4:
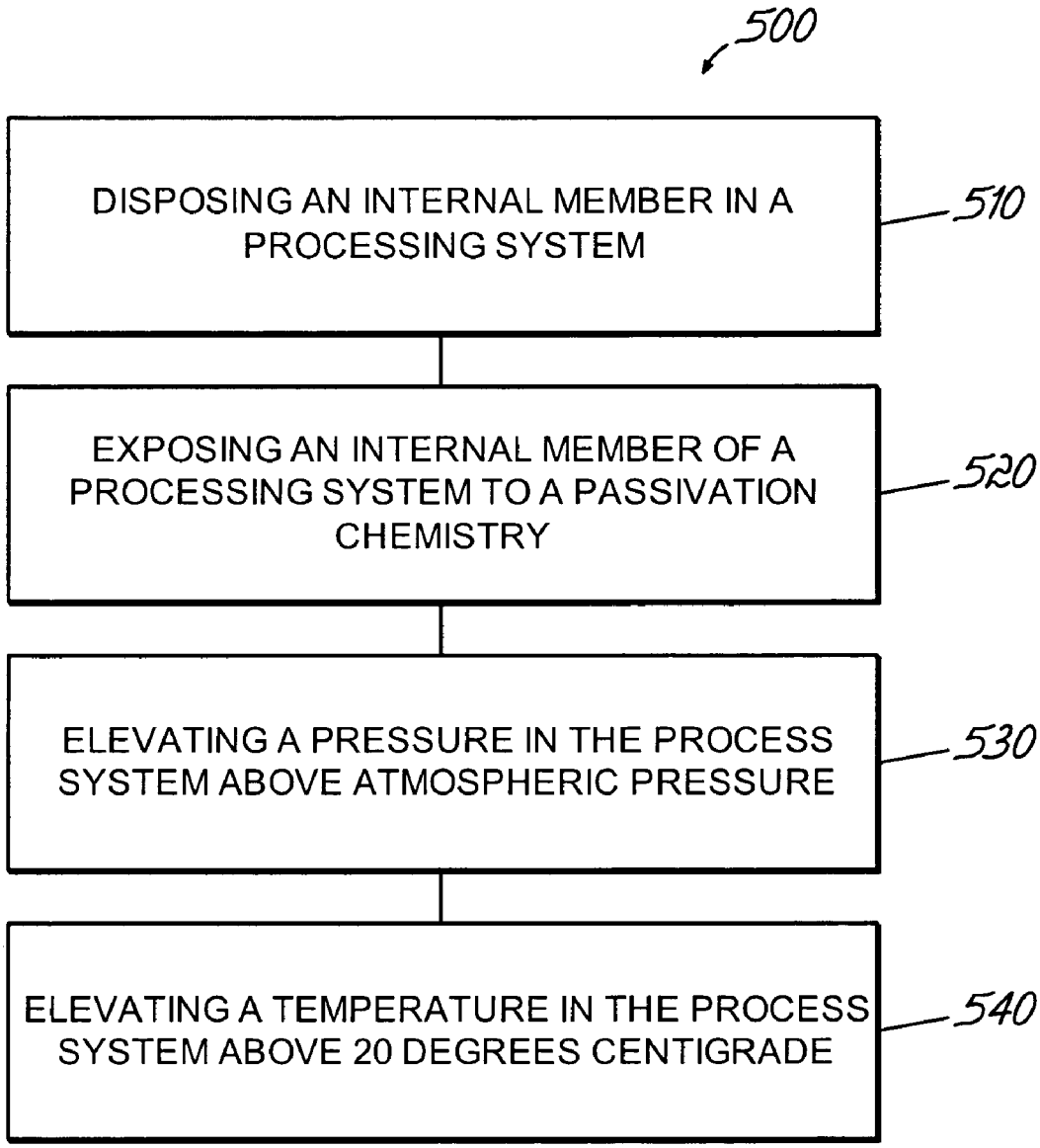
FIG. 4 illustrates a method of treating an internal member in a processing system.

FIG. 4 presents a method of treating one or more surfaces of internal members within a high pressure processing system. The method is a flow chart beginning in 510 with disposing an internal member configured to be coupled to a high pressure processing system in a treating chamber. For example, the treating chamber can include the high pressure processing system, such as processing system 100 or 200 described in FIGS. 1 and 2, or it may include the treating system described in FIG. 3. In 520, one or more surfaces of the internal member(s) are exposed to a passivation composition. The passivation composition can comprise an acid, such as citric acid, or nitric acid, or both. Additionally, the passivation composition can include a carrier medium. The carrier medium can include a high pressure fluid, or supercritical fluid, such as supercritical carbon dioxide.

In 530, the fluid pressure in the high pressure processing system is elevated above atmospheric pressure in order to expand the internal members. For example, the pressure can range from approximately 50 psi to approximately 10000 psi. Additionally, for example, the pressure ranges from approximately 100 psi to approximately 5000 psi, and by way of further example, the pressure ranges from approximately 500 psi to approximately 3500 psi. By way of still further example, the fluid pressure can range from approximately 2000 psi to approximately 3000 psi. In 540, the fluid temperature is elevated above 20 degrees C. For example, the fluid temperature can range from approximately 20 degrees C. to approximately 500 degrees C. Additionally, for example, the fluid temperature can range from approximately 20 degrees C. to approximately 200 degrees C. By way of further example, the fluid temperature can range from approximately 40 degrees C. to approximately 100 degrees C.

As an example, an internal member is installed in a processing system, such as processing system 100 or 200 described in FIGS. 1 and 2, respectively. The processing system is filled with carbon dioxide, which is re-circulated throughout the processing system. Thereafter, nitric acid is injected into the recirculating carbon dioxide until approximately 10% by volume nitric acid is achieved. Thereafter, the passivation composition are re-circulated through the internal member and processing system at a pressure of approximately 3000 psi and a temperature of approximately 100 degrees C. for a time duration of approximately 10 minutes. Following the passivation process, fresh carbon dioxide is circulated through the processing system for approximately 3 minutes, and approximately 500 milliliters of de-ionized water is introduced to the carbon dioxide and circulated for approximately 2 minutes in order to purge the processing system of the passivation composition. Following the first rinsing step, fresh carbon dioxide is circulated through the processing system for approximately 3 minutes, and approximately 500 milliliters of isopropyl alcohol is introduced to the carbon dioxide and circulated for approximately 2 minutes in order to further purge the processing system of the passivation composition. Following the second rinsing step, fresh carbon dioxide is circulated through the processing system for approximately 3 minutes.

As another example, an internal member is installed in a treating system, such as the one described in FIG. 3. The internal member is filled with carbon dioxide having approximately 10% by volume citric acid and slowly pressurized by a pump using a volume flow rate of approximately 30 milliliter/minute. When the pressure reaches approximately 2800 psi, the control valve opens, the passivation composition is released, and the high pressure cycling of the internal member continues. The fluid temperature is approximately 50 degrees C.

It is believed that an internal member, particularly a member of stainless steel, for example, that is configured to be coupled to a high pressure processing system, when treated by disposing it in high pressure in the processing system or a separate treating system, is more effectively cleaned of contaminants that collected in sites on the member when the member was coupled to the high pressure processing system, when passivation chemistry is provided at a pressure sufficiently above atmospheric pressure to expose contaminated sites, because exposure of those sites would not be so readily achieved by exposure to chemistry at atmospheric pressure. Whether this belief is correct or not, the advantageous result is nonetheless achieved by the invention. Furthermore, it is found that when the temperature is increased from 20 degrees centigrade to approximately 100 degrees centigrade, the effectiveness of the process of cleaning the member is substantially improved. Increasing the fluid temperature to at least approximately 100 degrees C. is particularly effective.

The examples are provided for illustrative purposes only. It will be understood by those skilled in the art that a passivating process can have any number of different time/pressures or temperature profiles without departing from the scope of the present invention. Further, any number of purging or rinsing sequences is contemplated. Also, as stated previously, concentrations of various chemicals and species within a carrier fluid can be readily tailored for the application at hand and altered at any time within a passivation step.

Although only certain exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A method of treating internal members of a processing system and treating substrates with supercritical fluid, comprising:

without a substrate present in a processing chamber of the system for processing therein, filling the process chamber of the processing system with carbon dioxide in a generally supercritical state at or above a pressure of about 1070 Psi and at or above a temperature of about 31 degrees C, recirculating the carbon dioxide through the processing system in contact with internal members thereof that are composed substantially of stainless steel, injecting nitric acid into the recirculating carbon dioxide in the system to form a passivation composition, re-circulating the passivation composition through the processing system to expose internal members thereof to the passivation composition, then purging the processing system of the passivation composition by recirculating fresh carbon dioxide through the processing system, wherein the purging of the processing system includes recirculating the fluid therein for at least approximately 3 minutes, then rinsing the processing system with a carbon dioxide and de-ionized water composition by introducing de-ionized water to the carbon dioxide and recirculating the composition through the system for approximately 2 minutes, then after rinsing the processing system, further purging the processing system by recirculating fresh carbon dioxide through the processing system for approximately 3 additional minutes, then further rinsing the processing system by introducing isopropyl alcohol to the carbon dioxide and recirculating the carbon dioxide and isopropyl alcohol composition through the system for approximately 2 minutes, then further purging the system again by recirculating fresh carbon dioxide through the processing system for approximately 3 minutes; then loading a semiconductor wafer into the chamber of the processing system;

filling the process chamber with carbon dioxide in a generally supercritical state at or above a pressure of about 1070 Psi and at or above a temperature of about 31 degrees C; and adding process chemistry that differs from the passivation composition to the carbon dioxide and recirculating the carbon dioxide and process chemistry through the processing system in contact with internal members and the semiconductor wafer and thereby treating a semiconductor wafer with a supercritical fluid composed of the carbon dioxide and the process chemistry.

2. The method of claim 1 wherein:

the injecting of nitric acid includes injecting nitric acid into the recirculating carbon dioxide in the system until approximately 10% by volume nitric acid is achieved to form a passivation composition.

3. The method of claim 2 wherein:

the re-circulating of the passivation composition through the processing system includes exposing the internal members to the passivation composition at a pressure of at least approximately 3000 psi and a temperature of approximately at least 100 degrees C for a time duration of approximately 10 minutes.

* * * * *